US008944275B2

(12) United States Patent
Schneider et al.

(10) Patent No.: US 8,944,275 B2
(45) Date of Patent: Feb. 3, 2015

(54) APPARATUS AND METHOD FOR INSTALLING A FLUID STORAGE TANK

(75) Inventors: William A. Schneider, Conroe, TX (US); Joseph R. Wiegand, Willis, TX (US)

(73) Assignee: Containment Solutions, Inc., Conroe, TX (US)

( * ) Notice: Subject to any disclaimer, the term of this patent is extended or adjusted under 35 U.S.C. 154(b) by 285 days.

(21) Appl. No.: 13/447,740

(22) Filed: Apr. 16, 2012

(65) Prior Publication Data

US 2013/0270277 A1 Oct. 17, 2013

(51) Int. Cl.
*B65D 90/02* (2006.01)

(52) U.S. Cl.
USPC ..... 220/565; 220/567.1; 405/154.1

(58) Field of Classification Search
CPC ..... B65D 88/76; B23P 17/04
USPC ..... 220/567.1; 29/428
See application file for complete search history.

(56) References Cited

U.S. PATENT DOCUMENTS

| | | | | |
|---|---|---|---|---|
| 2,006,669 | A * | 7/1935 | Clay | 280/838 |
| 2,124,441 | A * | 7/1938 | Thwaits | 220/686 |
| 4,955,573 | A * | 9/1990 | Horvath | 248/313 |
| 5,131,133 | A * | 7/1992 | Peterson et al. | 52/741.3 |
| 6,685,392 | B1 * | 2/2004 | Wokas | 405/52 |

* cited by examiner

*Primary Examiner* — Anthony Stashick
*Assistant Examiner* — Raven Collins
(74) *Attorney, Agent, or Firm* — Cantor Colburn LLP

(57) ABSTRACT

In one aspect, a fluid storage apparatus includes a fluid storage tank having a longitudinal axis. The apparatus also includes a channel disposed on an outer surface of the fluid storage tank, the channel configured to receive an anchor strap used to secure the fluid storage tank to a ground surface of an underground installation site.

16 Claims, 3 Drawing Sheets

APPARATUS AND METHOD FOR INSTALLING A FLUID STORAGE TANK

BACKGROUND OF THE DISCLOSURE

1. Field of the Disclosure

The disclosure relates generally to apparatus and methods for installation of fluid storage tanks.

2. Description of the Related Art

Fluid storage tanks may be used at various sites for various purposes. For example, fluid storage tanks made from a durable non-corrosive material, such as fiberglass reinforced plastic, may be used to store petroleum products and fuels at an underground location. Fluid storage tanks may also be used for storage of lubrication oils, water, wastewater, septic, chemicals, and alternative biofuels such as ethanol and biodiesel above or below ground.

In some cases, fluid storage tanks can be large, with diameters of 10 to 15 feet and lengths of 30 to 90 feet. The size of these fluid storage tanks can present challenges during installation at an installation site. For example, after placement at an installation site, an installer or operator may secure the fluid storage tank to the site to prevent movement of the tank over time. In some cases, straps are used to secure the tank where the operator is positioned on top of the tank to ensure proper placement of the straps as they are secured to the site. In some situations, having an operator positioned on top of the tank may add complexity to the installation process as certain safety precautions and procedures must be followed to prevent accidents.

SUMMARY

In one aspect, a fluid storage apparatus includes a fluid storage tank having a longitudinal axis. The apparatus also includes a channel disposed on an outer surface of the fluid storage tank, the channel configured to receive an anchor strap used to secure the fluid storage tank to a ground surface of an underground installation site.

In another aspect, a method for installation of a fluid storage apparatus in an underground installation site includes providing a fluid storage tank including a longitudinal axis; placing the tank in the underground installation site, threading an anchor strap through a channel disposed on the outer surface of the tank, wherein threading is done without an operator positioned on the fluid storage tank and securing the tank to the ground surface of the underground installation site.

BRIEF DESCRIPTION OF THE DRAWINGS

The disclosure herein is best understood with reference to the accompanying figures in which like numerals have generally been assigned to like elements and in which.

DETAILED DESCRIPTION

Figure 1:
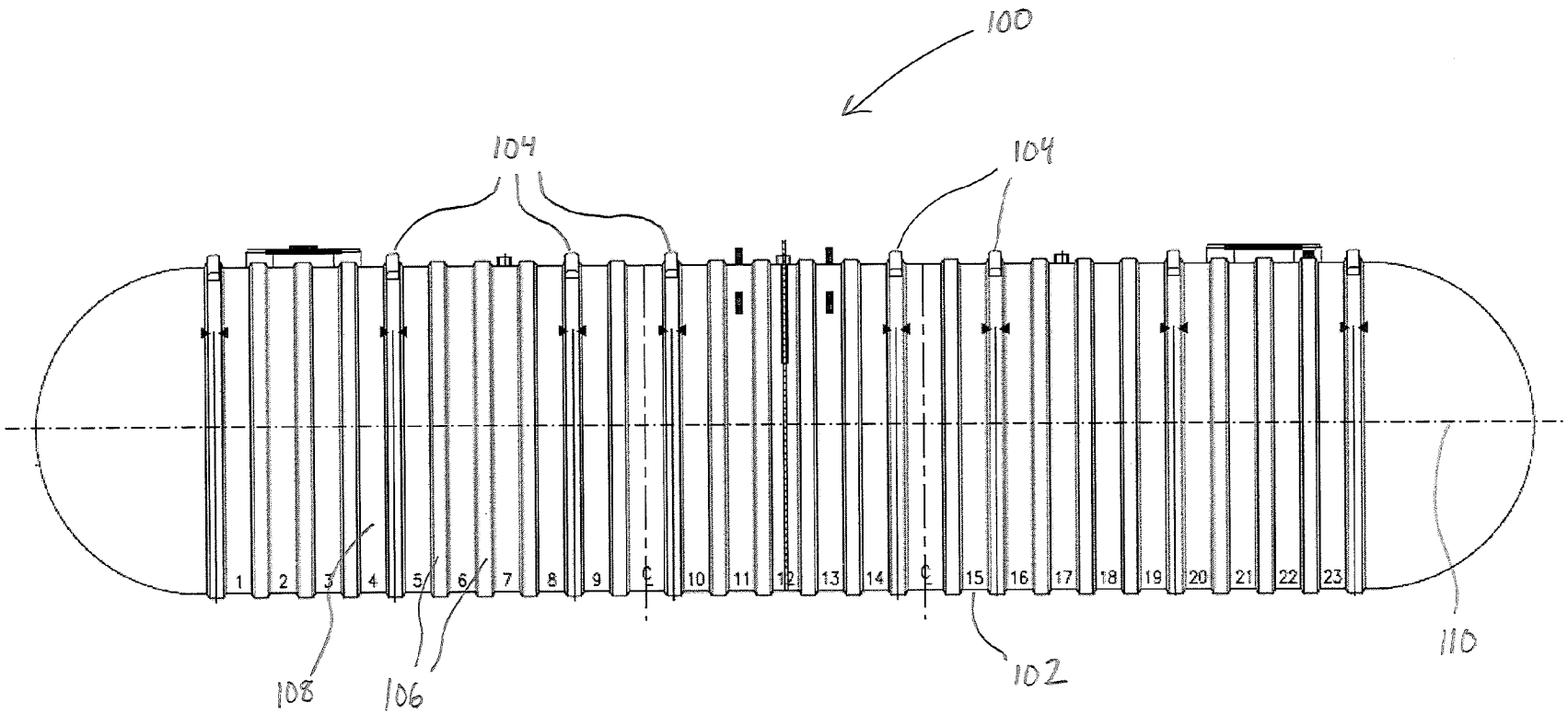
FIG. 1 is a side view of an exemplary fluid storage apparatus including a plurality of channels.

FIG. 1 is a side view of an exemplary fluid storage apparatus 100. The fluid storage apparatus 100 includes a fluid storage tank 102 and a plurality of channels 104. In an aspect, the fluid storage tank 102 also includes a plurality of ribs 106 on an outer surface 108 of the fluid storage tank 102. In an embodiment, the ribs 106 are circumferential ribs that extend radially from the surface 108, where the ribs 106 are substantially perpendicular to a longitudinal axis 110 of the fluid storage tank 102. In one aspect, the ribs 106 provide structural support and reinforcement for the fluid storage tank 102, where the tank is subjected to internal and external stresses during use. In an embodiment, the channels 104 are disposed on the ribs 106. In another embodiment, the fluid storage tank 102 may not include ribs and the channels 104 are disposed on the substantially uniform or smooth outer surface 108. In another embodiment, the fluid storage tank 102 may include ribs 106 and the channels 104 are disposed on the outer surface 108 between the ribs.

In an aspect, the channels 104 and the outer surface 108 form a cavity configured to receive anchor straps to secure the fluid storage tank 102. For example, as described more detail below, the channels 104 receive the anchor straps to secure the fluid storage tank 102 to a surface of an underground installation site. In addition, the channels 104 are positioned on the fluid storage tank 102 and receive the anchor straps from an operator that is located on a ground surface (e.g., not positioned on the tank), thus improving the installation process. In embodiments, the fluid storage tank 102 has any suitable shape, such as a substantially cylindrical shape. Further, the fluid storage tank 102 may be made from any suitable non-corrosive durable material, such as fiberglass reinforced plastic.

Figure 2:
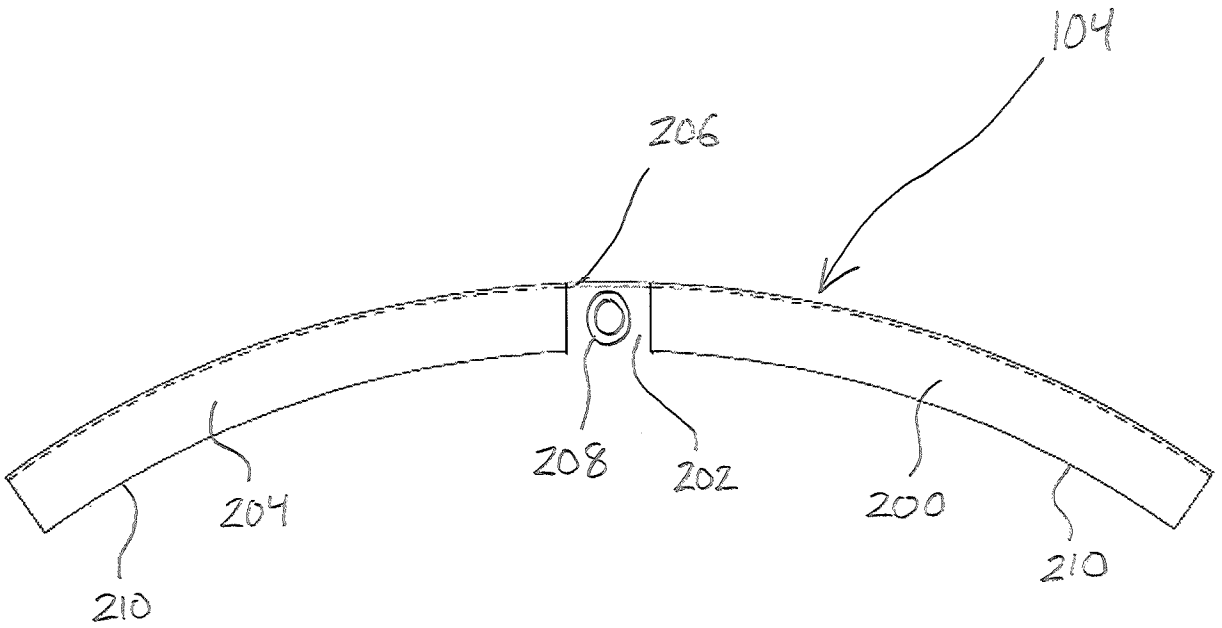
FIG. 2 is a detailed view of one of the channels 104 shown in FIG. 1.

FIG. 2 is a detailed view of the channel 104 shown in FIG. 1. The channel 104 is configured to be placed laterally (perpendicular to the longitudinal axis 110). The channel 104 comprises a substantially hollow member with a first side 200 and a second side 204 with a center portion 202 configured to allow a tubular member 208 to be positioned between the first side 200 and second side 204. A connecting member 206 in the center portion 202 connects the first and second sides 200, 204 to provide support during installation of the channel 104 as a unitary member on the tank and to guide the anchor straps as they are threaded through the channel 104. The connecting member 206 may be optionally removed after the anchor straps are secured to install one or more tubular members 208 with various diameters. In one embodiment, the channel 104 is continuous and does not include a cutout center portion 202. In an embodiment, an inner surface 210 of the channel 104 is coupled to the outer surface 108 of the fluid storage tank 102, thereby forming a passage or cavity to receive and guide the anchor straps from one lateral side of the fluid storage tank 102 to a second side of the tank. In one aspect, the channel 104 is formed from a durable, strong material, such as a plastic or composite material. The channel 104 may be coupled to the fluid storage tank 102 via an adhesive, fastener or other suitable coupling mechanism. In addition, the channel 104 may comprise any suitable shape to form the passage for the anchor straps, such as a U-shape or V-shape member.

Figure 3:
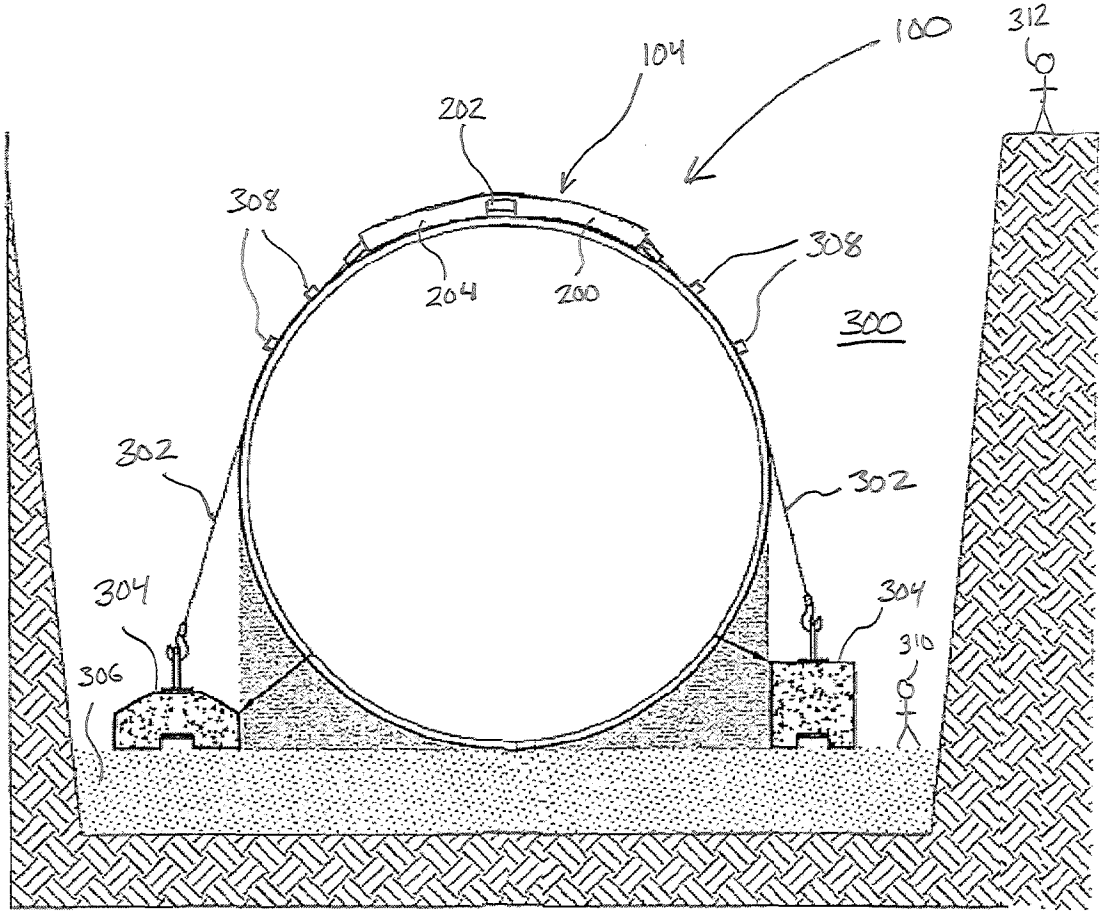
FIG. 3 is side sectional view of the fluid storage apparatus from FIG. 1 placed in an underground installation site.

FIG. 3 is a side sectional view of the fluid storage apparatus 100 placed in an underground installation site 300. The fluid storage tank 102 is secured via anchor straps 302 to anchors 304. The anchors 304 are coupled to, embedded in or otherwise coupled to a ground surface 306 of the underground installation site 300. Accordingly the anchors 304 enable securing of the fluid storage tank 102 at a selected location. In an embodiment, the anchors 304 may part of a concrete or other suitable pad extending under the tank. In an embodiment, positioners 308 may be located on anchor straps 302, tank surface 108, and/or rib 106, where the positioners 308 position the anchor straps 302 at desired locations on the tank. For example, the positioners 308 may be configured to center the anchor straps 302 on ribs 106. The positioners 308 may be made from a durable flexible material such as a polymer or composite. Positioners 308 may be coupled to or integrated into the anchor straps 302. In an embodiment, the positioners are attached to the ribs 106 or the tank wall 108. In an aspect, the anchor straps 302 are semi-flexible members made from a composite material, where a force is applied to deflect the anchor straps 302 and attach them to the anchors 304. The anchor straps secure the fluid storage tank 102 in the underground installation site 300 to prevent movement of the tank after installation. For example, the straps may prevent the tank from "floating" when the tank is empty and the surrounding ground area is saturated. In an embodiment, the channels 104 are configured to allow installation of anchor straps 302 when an operator is located on the ground surface at grade level, shown as element 312, or in the underground installation hole, shown as element 310, during the threading of the straps through the channels. For example, the operator may be at grade level next to or on the delivery truck during the threading process.

In addition, during transport of the fluid storage tank 102, flexible transport straps may be threaded through an eyelet of the tank prior to transport of the tank. Loops on each end of the transport straps may be secured to a transport trailer during transport. The loops are accessible by operators on the ground and may be coupled to a crane for lifting of the tank from the trailer after arrival at the installation site. Accordingly, by pre-threading the transport straps through the eyelet, operators and installers at the site can secure the fluid storage tank 102 to the crane without having an operator positioned on top of the tank. Accordingly, the arrangement simplifies transport and installation of the tank at the installation site.

While the foregoing disclosure is directed to certain embodiments, various changes and modifications to such embodiments will be apparent to those skilled in the art. It is intended that all changes and modifications that are within the scope and spirit of the appended claims be embraced by the disclosure herein.

The invention claimed is:

1. A fluid storage apparatus comprising:

a fluid storage tank having a longitudinal axis; and a channel disposed on an outer surface of the fluid storage tank, the channel configured to receive and guide an anchor strap between the channel and the outer surface of the fluid storage tank from a lateral side of the fluid storage tank to a second side of the fluid storage tank, wherein the anchor strap is used to secure the fluid storage tank to a ground surface of an underground installation site, wherein the channel comprises a member with a center portion configured to allow a tubular member to be positioned over the anchor strap along the longitudinal axis of the fluid storage tank.

2. The apparatus of claim 1, wherein the channel is configured to enable threading of the anchor strap through the channel and around the fluid storage tank without an operator being positioned on the fluid storage tank.

3. The apparatus of claim 2, wherein the operator is located on the ground surface at grade level or in the underground installation hole during the threading.

4. The apparatus of claim 1, comprising a plurality of channels disposed on the outer surface of the tank.

5. The apparatus of claim 1, comprising a plurality of ribs disposed about an outer surface of the fluid storage tank to provide structural support, the plurality of ribs being positioned in a substantially perpendicular direction to the longitudinal axis of the fluid storage tank.

6. The apparatus of claim 5, wherein the channel is disposed on one of the plurality of ribs.

7. The apparatus of claim 1, wherein the anchor strap comprises a plurality of positioners to position the anchor strap on the tank.

8. The apparatus of claim 1, wherein the member includes a connecting member that is removed to allow the tubular member to be positioned over the anchor strap.

9. A method for installation of a fluid storage apparatus in an underground installation site, the method comprising:

providing a fluid storage tank including a longitudinal axis;

placing the tank in the underground installation site;

threading an anchor strap through a channel disposed on the outer surface of the tank between the channel and the outer surface of the fluid storage tank from a lateral side of the fluid storage tank to a second side of the fluid storage tank, wherein threading is done without an operator positioned on the fluid storage tank, wherein the channel comprises a member with a center portion configured to allow a tubular member to be positioned over the anchor strap along the longitudinal axis of the fluid storage tank; and securing the tank to the ground surface of the underground installation site.

10. The method of claim 9, comprising threading a plurality of anchor straps through a plurality of channels disposed on an outer surface of the fluid storage tank.

11. The method of claim 10, wherein threading the anchor strap through the channel comprises threading the anchor strap through a channel disposed on one of the plurality of ribs.

12. The method of claim 9, wherein threading the anchor strap through the channel comprises threading the anchor strap with a plurality of positioners through the channel, the positioners being configured to position the anchor straps on the fluid storage tank.

13. The method of claim 9, wherein the member includes a connecting member that is removed to allow the tubular member to be positioned over the anchor strap.

14. A fluid storage apparatus, the apparatus comprising:

a fluid storage tank;

a plurality of ribs disposed about an outer surface of the fluid storage tank to provide structural support, the plurality of ribs being positioned in a substantially perpendicular direction to a longitudinal axis of the fluid storage tank; and a channel disposed on an outer surface of the fluid storage tank, the channel configured to receive and guide an anchor strap between the channel and the outer surface of the fluid storage tank from a lateral side of the fluid storage tank to a second side of the fluid storage tank, wherein the anchor strap is used to secure the fluid storage tank to a ground surface of an underground installation site, wherein the channel is configured to enable threading of the anchor strap through the channel and around the fluid storage tank without an operator being positioned on the fluid storage tank, wherein the channel comprises a member with a center portion configured to allow a tubular member to be positioned over the anchor strap along the longitudinal axis of the fluid storage tank.

15. The apparatus of claim 14, wherein the operator is located on the ground surface at grade level or in the underground installation hole during the threading.

16. The apparatus of claim 14, comprising a plurality of channels disposed on the outer surface of the tank.

* * * * *